US007698764B2

(12) United States Patent
Kemm

(10) Patent No.: US 7,698,764 B2
(45) **Date of Patent: *Apr. 20, 2010**

(54) SEAT

(76) Inventor: Leslie Gudel Kemm, 531 Winston Way, Berwyn, PA (US) 19312

( * ) Notice: Subject to any disclaimer, the term of this patent is extended or adjusted under 35 U.S.C. 154(b) by 0 days.

This patent is subject to a terminal disclaimer.

(21) Appl. No.: 12/202,958

(22) Filed: Sep. 2, 2008

(65) Prior Publication Data

US 2009/0056025 A1 Mar. 5, 2009

Related U.S. Application Data

(63) Continuation-in-part of application No. 11/544,654, filed on Oct. 10, 2006, now Pat. No. 7,418,752.

(51) Int. Cl.
*A47D 13/00* (2006.01)

(52) U.S. Cl. ..... 5/655; 5/633; 5/731

(58) Field of Classification Search ..... 5/632, 5/633, 655, 731–734, 603
See application file for complete search history.

(56) References Cited

U.S. PATENT DOCUMENTS

| | | | |
|---|---|---|---|
| 2,876,459 | A | 3/1959 | Ackerson |
| 3,729,752 | A | 5/1973 | Huggins |
| 4,027,888 | A | 6/1977 | Wilcox |
| 4,383,713 | A | 5/1983 | Roston |
| D276,577 | S | 12/1984 | Fitch |
| D278,004 | S | 3/1985 | Sigona |
| 4,631,766 | A | 12/1986 | Semmler et al. |
| 5,127,120 | A | 7/1992 | Mason |
| D333,752 | S | 3/1993 | Mason |
| 5,440,770 | A | 8/1995 | Nichols |
| D363,282 | S | 10/1995 | Wicks et al. |
| D372,805 | S | 8/1996 | Bonaddio et al. |
| 6,175,981 | B1 | 1/2001 | Lizama et al. |
| 6,647,572 | B2 | 11/2003 | Lee et al. |
| 6,823,545 | B1 | 11/2004 | Davis |
| D500,622 | S | 1/2005 | Owen et al. |
| 6,877,176 | B2 | 4/2005 | Houghteling |
| D526,498 | S | 8/2006 | Jimenez |
| D530,933 | S | 10/2006 | Vitaro |
| 7,234,181 | B1 | 6/2007 | Griggs |
| 2007/0022537 | A1 | 2/2007 | Faustick |
| 2008/0178387 | A1 | 7/2008 | Kachtick-Anders |

*Primary Examiner*—Michael Trettel
(74) *Attorney, Agent, or Firm*—Blank Rome LLP

(57) ABSTRACT

A seat that includes a support base including a substantially flat bottom surface, a concave portion formed in the support base opposite the flat bottom surface, the concave portion including a head rest area and a leg rest area at opposite ends of the concave portion, and a recessed area therebetween. The head rest area and the leg rest area having a height greater than the recessed area, and the substantially flat bottom surface of the support base extends from the head rest area to the leg rest area. First and second side walls extend between the head rest area and the leg rest area that border the concave portion.

13 Claims, 1 Drawing Sheet

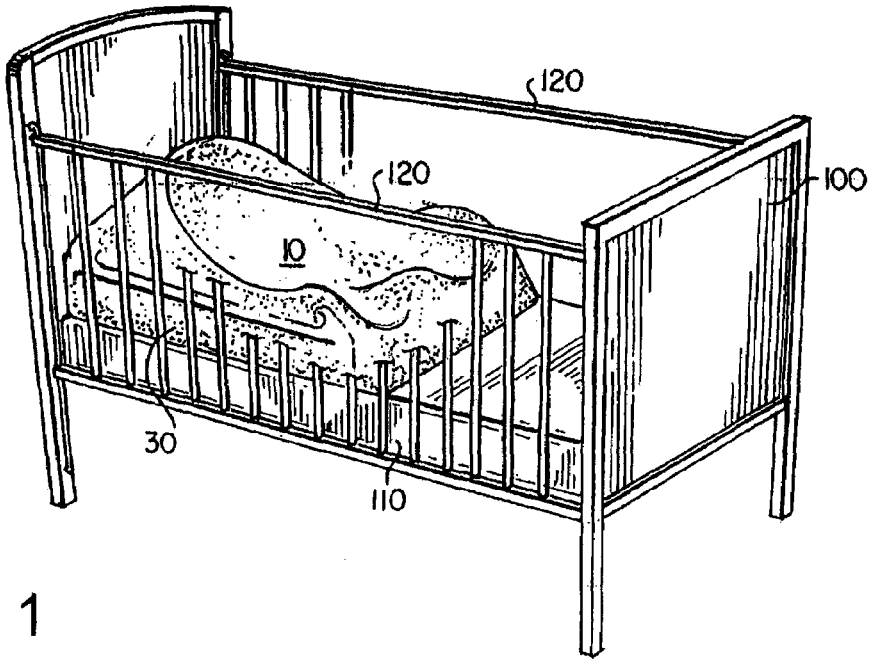
FIG. 1
FIG. 2
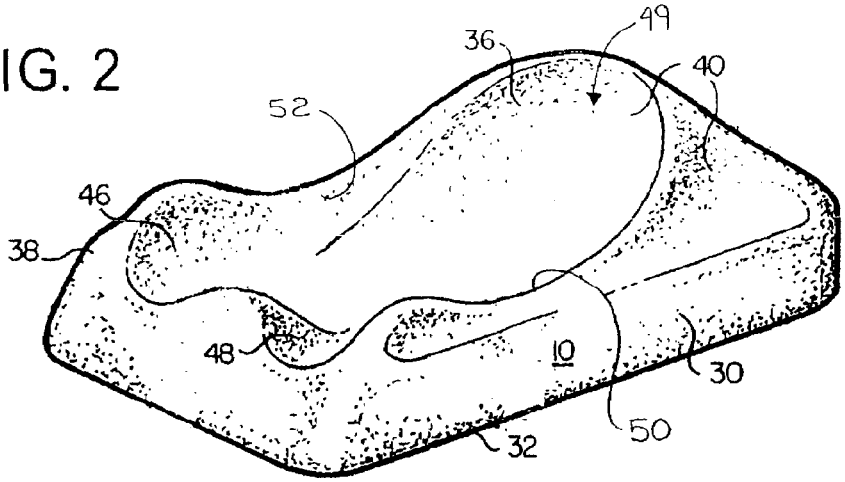
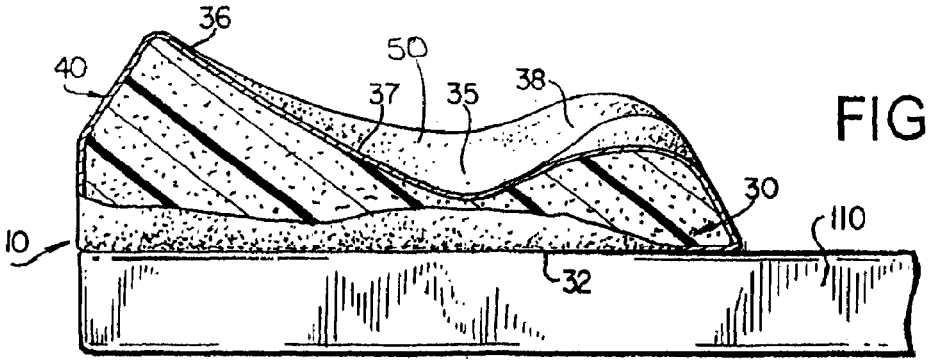
FIG. 3

SEAT

RELATED APPLICATION

This application is a Continuation-in-Part of U.S. patent Ser. No. 11/544,654, filed on Oct. 10, 2006, now U.S. Pat. No. 7,418,752 issued on Sep. 2, 2008, the subject matter of which is incorporated by reference in its entirety.

FIELD OF THE INVENTION

The present invention relates generally to a seat. The seat may provide a safe environment for an infant, for example, that mimics the sleep inducing environment normally experienced by an infant in a car seat while traveling in an automobile.

BACKGROUND OF THE INVENTION

Parents of infants are normally deprived of sleep if their infant cannot sleep during the night. These parents function at less than one hundred percent due to sleep deprivation. In today's economy where both parents often work, an infant that cannot sleep at night translates to a negative effect on the productivity of two people.

Some conventional infant supports are disclosed in U.S. Pat. Nos. 6,877,176 to Houghteling; 5,440,770 to Nichols; 5,127,120 and D333,752 to Mason; D500,622 to Owen 4,383,713 to Roston; 6,647,572 to Lee; and 6,175,981 to Lizama et al., the subject matter of each of which is incorporated by reference.

U.S. Pat. No. 6,877,176 to Houghteling discloses a portable infant sleep aid that provides an inclined sleeping position to help maintain a safe sleeping position; U.S. Pat. No. 5,440,770 to Nichols discloses an infant support device with a supporting surface contoured to receive an infant in an upwardly-facing inclined position; U.S. Pat. No. 5,127,120 to Mason discloses an infant support pad of constructed foam molded to a desired shape; U.S. Pat. No. D500,622 to Owen discloses a design for a support; U.S. Pat. No. 4,383,713 to Roston discloses a support apparatus for infants having support pieces for an infants head and torso; U.S. Pat. No. 6,647,572 to Lee discloses a cushion and vibration device; and U.S. Pat. 6,175,981 to Lizama et al discloses a child's flat animal shaped bed mat that includes a vibration mechanism.

SUMMARY OF THE INVENTION

Accordingly, the present invention provides a seat that includes a support base including a substantially flat bottom surface, a concave portion formed in the support base opposite the flat bottom surface, the concave portion including a head rest area and a leg rest area at opposite ends of the concave portion, and a recessed area therebetween. The head rest area and the leg rest area having a height greater than the recessed area, and the substantially flat bottom surface of the support base extends from the head rest area to the leg rest area. First and second side walls extend between the head rest area and the leg rest area that border the concave portion.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages will be readily ascertainable after referencing the following detailed description in conjunction with the following figures:

FIG. 1 is a perspective view of a seat according to the present invention shown placed inside a standard infant crib on top of a standard crib mattress;

FIG. 2 is a perspective view of the seat illustrated in FIG. 1; and

FIG. 3 is a side elevational view of the seat illustrated in FIG. 1, shown in partial section.

DETAILED DESCRIPTION OF THE INVENTION

Referring to FIGS. 1-3, a seat 10 according to the present invention creates a car like sleeping experience for an infant inside the safety of the infant's crib 100, for example. The seat 10 may also be used on surfaces other than a mattress or in a crib, include a floor, table or the like. The seat 10 may include a support base 30; an infant resting indentation portion 35 resembling a car seat; and a fitted covering 40. For consistency, each numbered part of the device retains the same number designation across all of the figures.

The components of the seat 10 may be formed of water resistant and hypoallergenic material. Additionally, device 10 may contain a padded surface for the infant's comfort. The device 10 may be protected with a washable fitted cover 40.

The seat 10 is generally a combination of two basic shapes: a generally rectangular support base 30 and an infant car seat shaped concave portion 35 formed into an upper portion of the support base 30. The support base 30 may be adapted to sit on top of a crib mattress 110 or any other surface, such as a floor or table. The support base 30 may be solid or hollow. Although the support base 30 is preferably rectangular, the support base may have any shape, such as square or circular. The width of the support base 30 may be dimensioned so as to keep the device 10 from flipping over in the crib, thus providing a safe and stable environment for the infant. The width of the support base 30 along with the weight of the center of the seat allows for a sturdy, center-heavy seat that resists tipping. The seat 10 may also abut three or four edges of the crib 100 to prevent tipping. The support base 30 may be secured to the crib mattress 110 using a strap 20 to further prevent the possibility of flipping over. For example, the strap 20 may be attached to the back two corners of the seat 10. Because the device 10 can rest on top of the crib mattress 110, the height of the crib mattress 110 in relation to the top of the crib rails 120 may be lowered for protection of the infant from falling out of the crib.

The car seat shaped concave portion 35 generally conforms to the body shape of an infant. In order to accommodate infants of varying size, the concave portion 35 may be formed in different sizes and may also vary in shape. The concave portion 35 includes an angled surface 37 with respect to a flat bottom surface 32 of the infant's head rest area 36 of concave portion 35 is above an infant's leg area 38 thereby mimicking the position of the infant while riding in a car seat. First and second side walls 50 and 52 border the concave portion 35 and extend between the head and leg rest areas 36 and 38. At the leg area 38, first and second indentations 46 and 48 may be provided for accommodating the legs of the infant. A recessed area 49 is disposed between areas 36 and 38 so that the head and legs of the infant are elevated. The angled surface 37 may vary with respect to the flat bottom surface 32. The infant may be secured to the car shaped concave portion 35 using a restraint, such as a strap system. For example, the strap system 31 may be formed with a single strap between the legs of the infant that intersects another strap that attaches to the seat 10 on each side of the infant at the infant's waist.

A removable head rest (not shown) may be provided to support the infant's head. The removable head rest may be formed with hypoallergenic material and may be encased within a removable hypoallergenic covering that is machine washable. The removable head rest may be attached to the head area 36 of the device 10 by a fastening material.

The support base 30 may have one or more vibration devices, placed depending on the dimensions of the car seat concave portion 35, to simulate the motion experienced by an infant when traveling in an automobile. For safety reasons, the vibrating mechanisms preferably use direct current (DC). The DC voltage is supplied by a power source, such as either batteries or by an alternating current (AC) to DC adapter plugged into a nearby wall outlet.

While a particular embodiment has been chosen to illustrate the invention, it will be understood by those skilled in the art that various changes and modifications can be made therein without departing from the scope of the invention as defined in the appended claims. For example, although the seat 10 is described for use with infants, the seat may be sized for adults.

What is claimed is:

1. A seat, comprising of:

a support base including a substantially flat bottom surface;

a concave portion formed in said support base opposite said flat bottom surface, said concave portion including a head rest area and a leg rest area at opposite ends of said concave portion, a recessed area therebetween, said head rest area and said leg rest area having a height greater than said recessed area, and said substantially flat bottom surface of said support base extends from said head rest area to said leg rest area; and first and second side walls extending between said head rest area and said leg rest area that border said concave portion.

2. A seat as claimed in claim 1, further comprising:

a protective outer covering.

3. A seat as claimed in claim 2, wherein said protective covering is formed of a water resistant, washable material.

4. A seat as claimed in claim 2, wherein said protective covering is formed with padding using a hypoallergenic material.

5. A seat as claimed in claim 1, wherein said support base is formed of a hypoallergenic material.

6. A seat as claimed in claim 1, wherein said concave portion includes an angled surface with respect to said flat bottom surface.

7. A seat as claimed in claim 1, wherein said concave portion includes a pad.

8. A seat as claimed in claim 1, further comprising a fastener for stabilizing said support base.

9. A seat as claimed in claim 1, further comprising a restraining member coupled to said support base.

10. A seat as claimed in claim 1, wherein said support base is square, said concave portion has a polygonal, circular, or oval shape.

11. A seat as claimed in claim 1, wherein said recessed area contains a ridge at one end of said leg area.

12. A seat as claimed in claim 1, wherein said support base includes a vibrating mechanism for simulating the motion of an automobile.

13. A seat, comprising of:

a support base including a substantially flat bottom surface;

a concave portion formed in said support base opposite said flat bottom surface, said concave portion including a head rest area and a leg rest area at opposite ends of said concave portion, said leg rest area having a central ridge dividing first and second leg indents;

a recessed area between said support base and said concave portion, said head rest area and said leg rest area having a height greater than said recessed area, and said substantially flat bottom surface of said support base extends from said head rest area to said leg rest area;

first and second side walls extending between said head rest area and said leg rest area that border said concave portion; and a vibrating mechanism disposed in said support base simulating the motion of an automobile.

* * * * *